US008371359B2

(12) United States Patent
Morris

(10) Patent No.: US 8,371,359 B2
(45) **Date of Patent: *Feb. 12, 2013**

(54) TRACK ASSEMBLY FOR SUPPORTING FABRICS

(76) Inventor: Milton A. Morris, Woodland Hills, CA (US)

( * ) Notice: Subject to any disclaimer, the term of this patent is extended or adjusted under 35 U.S.C. 154(b) by 226 days.

This patent is subject to a terminal disclaimer.

(21) Appl. No.: 12/690,538

(22) Filed: Jan. 20, 2010

(65) Prior Publication Data

US 2010/0116445 A1 May 13, 2010

Related U.S. Application Data

(63) Continuation-in-part of application No. 11/096,560, filed on Apr. 1, 2005, now Pat. No. 7,650,923.

(60) Provisional application No. 60/617,977, filed on Oct. 11, 2004, provisional application No. 60/599,563, filed on Aug. 5, 2004, provisional application No. 60/562,966, filed on Apr. 16, 2004.

(51) Int. Cl.
*A47H 23/00* (2006.01)

(52) U.S. Cl. ..... 160/327; 52/222

(58) Field of Classification Search ..... 160/327, 160/328, 383, 391, 392, 395, 183, 233, 234, 160/235, 380, 402; 52/202, 222; 16/355, 16/374

See application file for complete search history.

(56) References Cited

U.S. PATENT DOCUMENTS

| | | | | | |
|---|---|---|---|---|---|
| 873,359 | A | * | 12/1907 | Erwood | 160/235 |
| 3,118,702 | A | * | 1/1964 | Kale et al. | 296/106 |
| 3,822,734 | A | | 7/1974 | Tombu | |
| 3,833,046 | A | | 9/1974 | Tombu | |
| 3,848,380 | A | | 11/1974 | Assael | |
| 4,114,233 | A | * | 9/1978 | Hamilton | 16/95 R |
| 4,197,686 | A | | 4/1980 | Baslow | |
| 4,403,642 | A | | 9/1983 | Morris | |
| 4,549,334 | A | | 10/1985 | Miller | |
| 4,625,490 | A | | 12/1986 | Baslow | |
| 4,805,330 | A | | 2/1989 | Bubernak | |
| 4,825,931 | A | | 5/1989 | Fein | |
| 4,986,332 | A | | 1/1991 | Lanuza | |
| 5,214,891 | A | | 6/1993 | Edlin | |
| 5,230,377 | A | | 7/1993 | Berman | |
| 6,122,868 | A | | 9/2000 | Knezevich | |
| 6,164,364 | A | | 12/2000 | Morris | |
| 6,431,251 | B1 | | 8/2002 | Yerusalim et al. | |
| 7,650,923 | B2 | * | 1/2010 | Morris | 160/327 |

* cited by examiner

*Primary Examiner* — David Purol
(74) *Attorney, Agent, or Firm* — Kelly & Kelley, LLP

(57) ABSTRACT

A track assembly for supporting fabric on a surface includes a base track defining a first half of a hinge and a first half of a snapping clamp. An upper track defines a second half of the hinge and is pivotally connectable to the base track. The upper track defines a second half of the snapping clamp for releasably engaging the fabric. The upper track includes a strut extended downwardly towards the base track such that when high tension forces are applied to the upper track, due to fabric tensioning, the strut contacts the base track to reinforce the track assembly.

27 Claims, 7 Drawing Sheets

TRACK ASSEMBLY FOR SUPPORTING FABRICS

BACKGROUND OF THE INVENTION

The present invention generally relates to fabric wall coverings. More particularly, the present invention relates to a track assembly for supporting fabrics on a surface, such as a wall, under high tension, even in thicker assemblies which accommodate acoustical panels and the like.

It is known to provide a framework formed of plastic channeling fastened by means of staples or other means onto the marginal areas of an interior wall to be covered with fabric. U.S. Pat. Nos. 4,403,642 and 6,164,364 disclose track assemblies having two track halves, each having one-half of a hinge and a snapping clamp which interlocks the fabric and clamps the two tracks onto one another. Such assemblies have performed generally adequately for interior walls and the like to be covered with a fabric.

Such wall, which may be formed of unfinished sheet rock, plaster, cinder block, concrete or wood, requires no preparation other than the installation of the channeling. The fabric material to be applied to the framework is first cut to the exact dimensions required, taking into account that the fabric sheet is to be subjected to tension on the framework. The installation procedure is set so as to tension the fabric from top to bottom, and side to side, thereby imparting to the fabric wall covering a naturally smooth and tensioned finish. Preferably, the fabric is tensioned as tightly as possible to create a smooth and tensioned finish. As the fabric sections can be fairly large, this tensioning puts a tremendous strain on the track framework.

However, the track assemblies disclosed by the '642 and '364 patents have various shortcomings. A primary shortcoming is that, due to the large tension forces on the upper and lower track members from the fabric, the closing and locking of the upper track member, to which the fabric is attached to the base track member, is very difficult. Although the hook and catch of the snapping clamp are only a fraction of an inch in size, moving them this fraction of an inch so that they engage and lock with one another requires pounding with mallets, etc.

The track assemblies of the '642 and '364 patents are one-half inch systems. There are other instances, such as when insulating or acoustic panels are used within the track perimeter, when a thicker system is required. Rigid fiberglass panels, usually in thicknesses of one inch, have become a standard for insulating and acoustically treating commercial structures. In addition to conserving energy, fiberglass panels provide acoustical benefits. Such panels are commonplace in movie theaters and other arenas in which sound quality is a concern. Sound energy strikes the panel and is converted to heat. Depending on the thickness and density of the fiberglass, a certain percentage of sound is absorbed as well as reflected.

When used as an acoustical finish, fiberglass panels require that a decorative cover, usually fabric or vinyl, be applied over the panel. The application of covering material in the past has relied upon an adhesive to glue and secure the material to the panel. The panel edges are wrapped and glued again on the panel's reverse side. Due to the soft and spongy nature of the material, edges tend to be soft and subject to irregularities due to dents caused by handling of the panels. When wrapped and installed adjacent to other panels, edges tend to be inconsistent with one another and unsightly gaps often result.

To counter this problem, finished panel suppliers typically treat the soft panel edges with a non-viscous liquid resin which wicks into the glass matting. When cured, the resin is solid and can be tooled to achieve a straight permanent edge in a variety of shapes. This application achieves a quality edge.

However, these gains are not necessarily beneficial toward achieving a desired and specified acoustical target. Manufacturers of rigid fiberglass panels provide acoustical ratings of their products in the raw state, which are relied upon by consumers. Serious differences may exist, however, between acoustical ratings as represented by manufacturers and what actually is delivered by a contractor who has finished the panel to achieve a straight permanent edge. Furthermore, such acoustical ratings may be altered by the spraying of adhesive onto the fiberglass panels to secure the covering material. Adhesive can act as a barrier to the transmission of sound and reduce the panel's acoustical effectiveness. Additionally, resin is a solid substance which is highly reflective of sound. As stated above, the primary objective of such fiberglass panels is to absorb sound and minimize sound reflection.

Other concerns with currently existing fiberglass panels is that they are fixed dimension panels which do not allow for covering out of square walls. Furthermore, should the consumer wish to change the decor, all of the acoustical material must be replaced at a great expense.

Unfortunately, the track assemblies of the '642 and '364 patents relate to products which are only half-inch systems. From both a geometric as well as a material standpoint, these designs are impractical for adaption to the dimensions of a one inch fiberglass panel system. The doubling of the distance from the wall impacts the proposed product in that new profiles (.e.g. a beveled, bull-nose and square profile) add different dimensional, geometric and material deflection considerations not present in the prior art. There is also the concern that the top bracket will actually become disengaged with bottom bracket due to the tension forces applied to the track assembly by the tensioned fabric. The overall track assembly geometry is rectangular; when fabric is tensioned, forces applied to the assembly can distort or deform the rectangle into a parallelogram shape. Due to the high tension forces, the fabric can slip from the snapping clamp or disengage the snapping clamp. The hinges of these devices are also prone to failure. These problems are particularly acute in one-inch systems.

Accordingly, there is a continuing need for a fabric mounting track assembly which is designed such that the hook and catch member more easily engage and lock with one another. What is also needed is a design for a track assembly which is reinforced so as to resist the tendency to become deformed. There is also a continuing need for a fabric mounting assembly which is particularly designed for use with such fiberglass acoustical panels. Such an assembly should be able to cover the fiberglass panel with an aesthetically pleasing fabric without substantially altering the acoustical performance of the panels. Moreover, such an assembly should be capable of allowing the fabric to be replaced over time to accommodate the changes in decor or to provide access to wiring, equipment or acoustical materials behind the fabric, without replacing the insulated or acoustic material nor the track assemblies. The present invention fulfills these needs and provides other related advantages.

SUMMARY OF THE INVENTION

The present invention resides in a track assembly for supporting fabric on the surface which overcomes the disadvantages and shortcomings of the prior art. The track assembly generally comprises a base track defining a first half of a hinge and a first half of a snapping clamp. An upper track defines a second half of the hinge, and second half of the snapping clamp. Typically, the second half of the snapping clamp of the upper track comprises a hook, and the second half of snapping clamp of the base track comprises a catch, which are configured to releasably engage and form the snapping clamp.

After securement of the base track to the surface, such as a wall, the upper track can be hinged to the base track with the coupling of the first and second halves of the hinge. The upper track is then swingable about the hinge away from the surface to facilitate placement of the fabric over the second half of the snapping clamp. Swinging of the upper track towards the base track causes the first and second halves of the snapping clamp to secure the fabric therebetween.

An elongated strut is disposed intermediate the second half of the hinge and the second half of the snapping clamp, and extends from the upper plate of the upper track towards the base track. The elongated strut extends at one end thereof from the upper plate at a non-perpendicular angle with respect to the upper plate away from the snapping clamp and towards an elevated surface of the base track facing the snapping clamp. In the presence of forces applied to the track assembly by the fabric, the strut extends between the upper track and the elevated surface of the base track to resist opening of the snapping clamp and distortion of the track assembly due to the fabric tension forces. In one embodiment, at least a portion of the strut engages an outer surface of the first hinge member of the base track to resist opening of the snapping clamp and distortion of the track assembly due to the fabric tension forces. The strut may extend between the upper track and the outer surface of the first hinge member of the base track, the strut being compressed generally along a length thereof in response to engagement with the upper track and the first half of the hinge base track in the presence of fabric tension forces.

In another embodiment, or in addition to the previously described embodiment, the base track includes a tension force dissipater. The dissipater typically extends from the first half of the hinge and is comprised of elevated segments of a base plate of the base track. The elevated segments typically form a generally inverted V-shape. The high tension forces applied to the upper track are at least partially transmitted, such as through the strut, to the tension force dissipater and to the surface of the wall or the like. The transmission and dissipation of the tension forces prevents the snapping clamp from becoming disengaged and the fabric being released.

In the embodiments described above, a projection may extend from the outer surface of the first half of the hinge facing the snapping clamp to limit the movement of the strut along the surface of the first half of the hinge due to high tension forces.

In a particularly preferred embodiment, a tab extends upwardly from an upper plate of the upper track adjacent to the second half of the snapping clamp. This prevents shadowing effects which might otherwise occur if the fabric rests on the upper track directly.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

As shown in the accompanying drawings for purposes of illustration, the present invention resides in a track assembly for covering walls with a fabric or the like. As discussed above, very tight tensioning of fabric panels can impose very high loads on the relatively light-weight hinge and track assembly structures. The spans of fabrics to be stretched can exceed thirty by twenty-five feet, and the fabric panels alone can weigh fifty pounds or more. In the prior art, there was a continuing concern that the fabric could become dislodged from the track assembly due to the tension exerted thereon by the stretched fabrics. Certain track assemblies, particularly those of approximately one-inch thickness, having a generally rectangular closed configuration, could be deformed and moved into a generally parallelogram shape due to the high tension forces of the stretched fabric. As will be more fully described herein, the track assembly of the present invention discloses a design incorporating a strut and a high tension dissipater which accommodates these high tension forces, even in a one-inch thick assembly.

Figure 1:
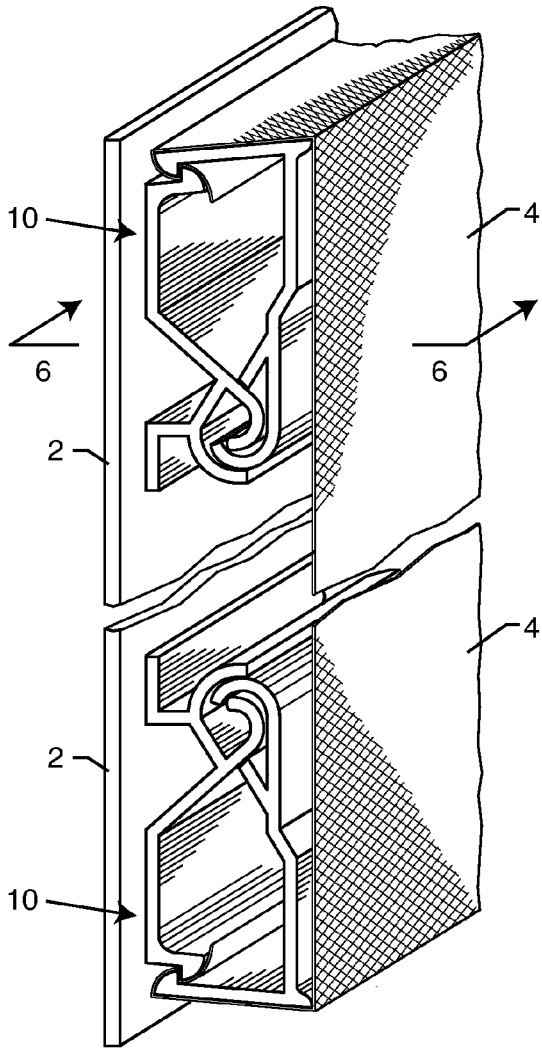
FIG. 1 is a fragmented side perspective view of a pair of track assemblies embodying the present invention, and supporting a fabric therebetween.
Figure 2:
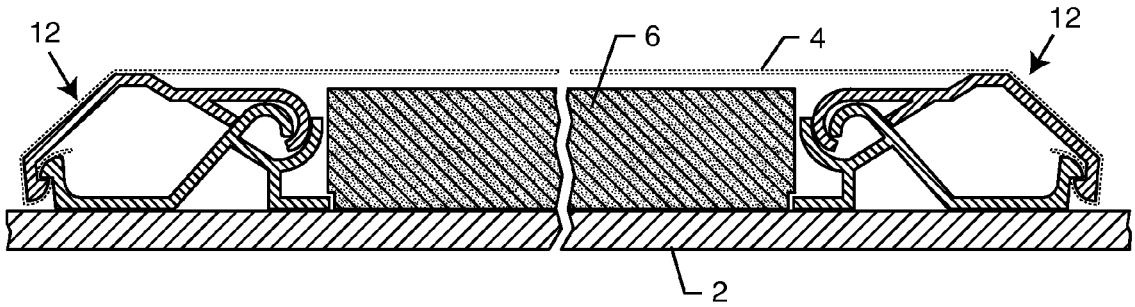
FIG. 2 is a cross-sectional view similar to FIG. 1, but illustrating an insulated or acoustical panel between the track assemblies.

With reference now to FIGS. 1 and 2, there is shown a surface 2, such as a wall, which is partly broken away, and includes a fabric covering 4 supported by a framework made up of the track assemblies 10 and 12, respectively. In the embodiments illustrated in FIGS. 1-8, the track assemblies are approximately one-inch in thickness so as to accommodate insulative or acoustical panels 6, which as described above, can be comprised of fiberglass, fiber board, or other appropriate material. As illustrated in FIGS. 1 and 2, the track assemblies 10 and 12 serve to stretch the fabric 4 over a portion of the wall 2 or other surface.

With reference now to FIGS. 3-6, the assembly is comprised of a base track 100 and an upper track 102 which are pivotally connectable to one another and selectively interlocked. The base track 100 includes a generally flat base plate 104 which contacts the wall 2. The base track 100 is attached to the wall 2, such by nails, adhesive, or the like. Although the assemblies are shown fragmented in FIGS. 1-3, it will be appreciated by those skilled in the art that the base and upper tracks 100 and 102 are typically several feet in length necessary to support the fabric, or are sold in smaller segments which are abutted end to end to accommodate the width or length of the fabric. Preferably, the base track 100 and upper track 102 are extruded or molded and comprised of a plastic resin, such as an ABS-FR resin, so as to have a Class A rating for flame spread and smoke production.

With continuing reference to FIGS. 3-6, the base track 100 defines a first half of a hinge 106 defining a channel 108. Typically, the hinge portion 106 that is curved so as to have a generally C-shape or e-shape, although it is not limited to such. Typically, the hinge portion 106 is slightly off-set inwardly from the edge of the lower base plate 104, as will be described more fully herein. The C-shape of the hinge turns and extends inwardly such that an inner surface thereof defines a cavity or channel and acts as a guide for rotation for a mating hinge member, as will be more fully discussed herein. The curved extension also assists in the locking of the opposite hinge member, as compared to prior art designs.

Generally opposite the hinge portion 106, and typically defining the opposite longitudinal edge, is the first half of a snapping clamp 110. The snapping clamp includes a hook or catch 112 that extends upwardly from the base plate 104 and wall 2.

As illustrated, in a particularly preferred embodiment, the hinge portion 106 is elevated or extends away from the base plate 104 of the base track 100. Segments or legs 114 or 116 extend from the first half of the hinge 106 to the base plate portions 104. Such an arrangement typically forms a generally inverted V-shape. These segments 114 and 116 forming a tension force dissipater, will be more fully described herein.

Figure 3:
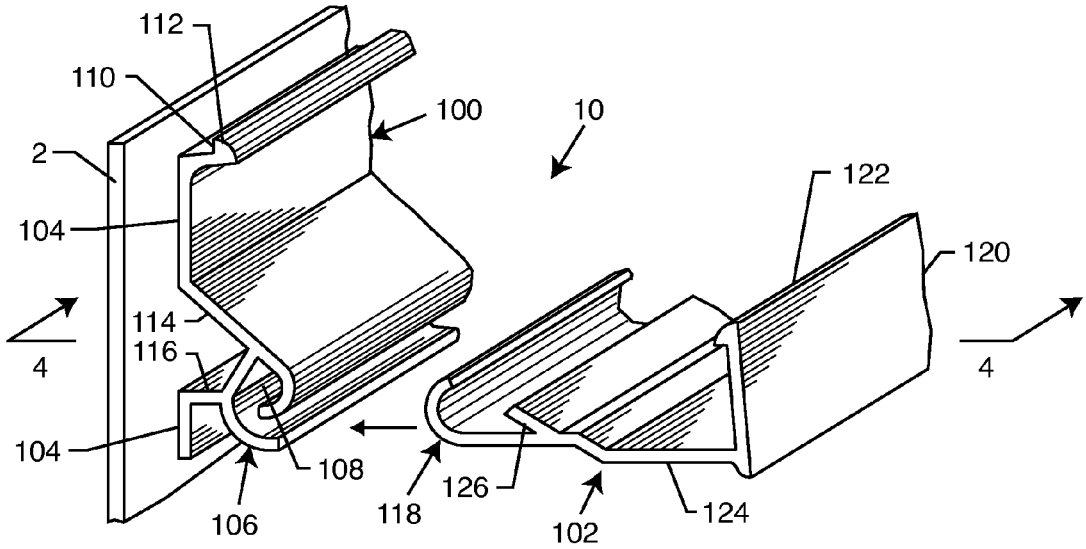
FIG. 3 is a perspective view of a base track affixed to a surface, and an upper track positioned for attachment thereto.
Figure 4:
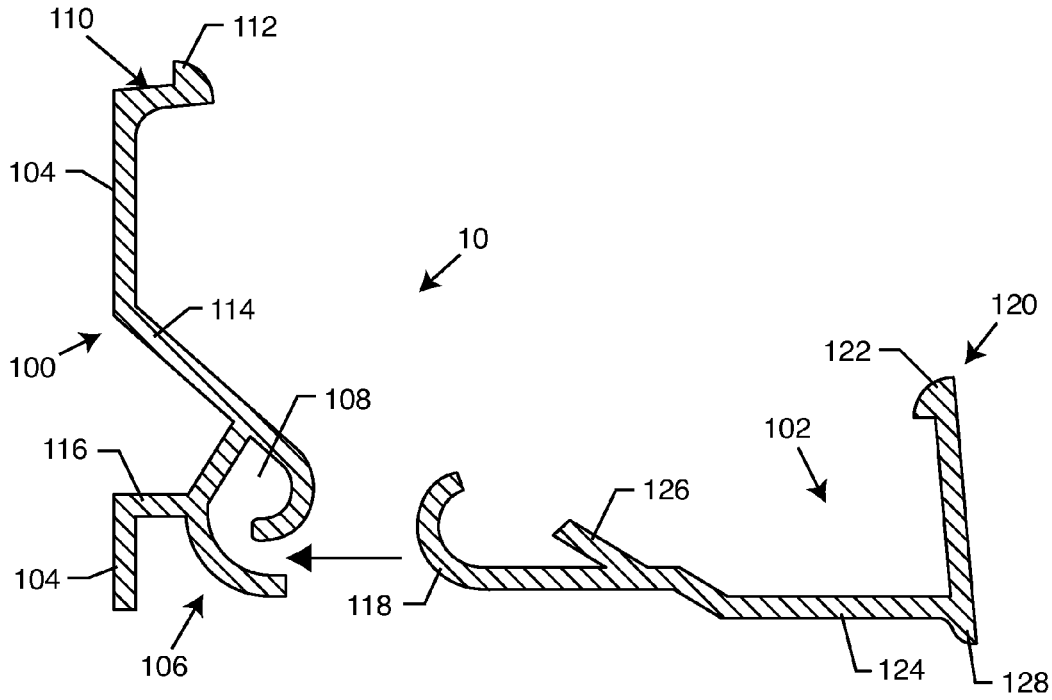
FIG. 4 is a cross-sectional view taken generally along line 4-4 of FIG. 3.
Figure 5:
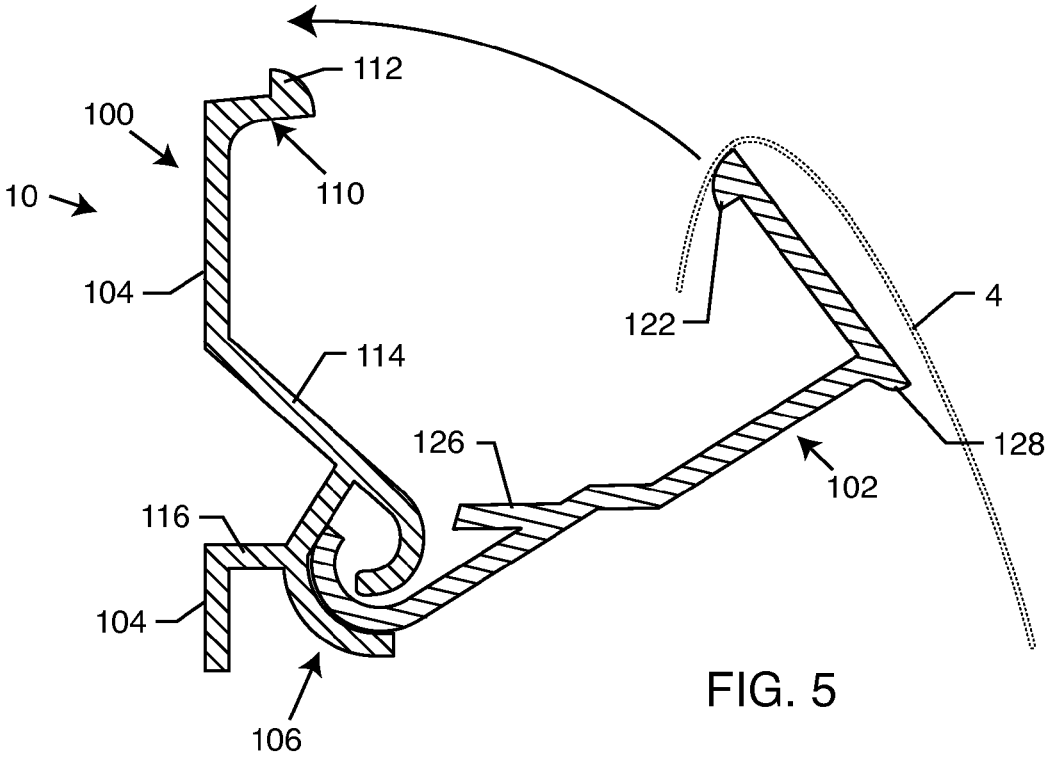
FIG. 5 is a cross-sectional view similar to FIG. 4, but illustrating the closing of the hinge assembly to secure fabric therein.

With reference to FIGS. 3 and 4, the assembly 10 also includes the upper track 102, which as previously described, cooperates with the base track 100 to form the assembly 10 and lock the fabric 4 tightly into place. The upper track 102 includes a second hinged portion 118, which is configured such so as to be inserted into the channel or cavity 108 of the first hinge portion 106 of the base track 100 so as to be at least partially received therein and rotate therein, and thus forms a hinge and pivotal connection between the base track 100 and the upper track 102, as illustrated in FIG. 5. Generally opposite the second hinge half 118 is formed the second half of the snapping clamp 120 which includes a hook or catch 122 which is intended to engage with the hook or catch 112 of the base track 100 to form a releasably snapping clamp. The upper track 102 has what is referred to herein as an upper plate 124 which extends between the hinge portion 118 and the clamp portion 120. In the illustrated embodiments of FIGS. 1, and 3-6, the configuration or profile of the upper track 102 is referred to in the industry as square, due to the approximately 90° angle formed in the upper plate 124 to the snapping clamp portion 120. This configuration results in a generally square edge in the final fabric panel edges.

Figure 6:
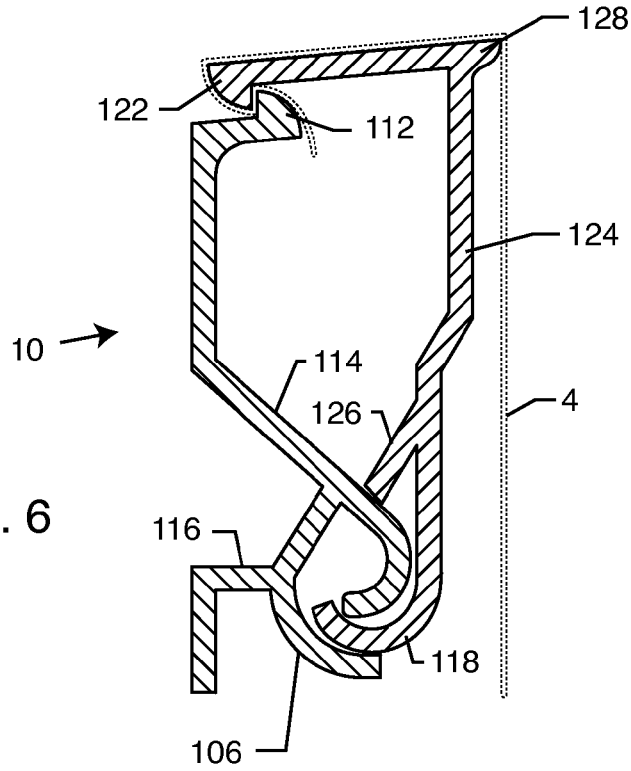
FIG. 6 is a cross-sectional view taken generally along line 6-6 of FIG. 1, illustrating a track assembly in a closed state and securing fabric.

In a particularly preferred embodiment, as illustrated in FIGS. 4-6, the upper plate 124 includes a tab 128 extending upwardly therefrom a fraction of an inch. The tab 128 is designed and sized so as to enable the fabric 4 to rise slightly above the parallel mounting surface of the upper plate 124 so as to minimize the reflection of light from the extrusion and resultant shadow box effect encountered with prior art assemblies. As will be appreciated by those skilled in the art, the fabric is typically positioned and aligned with alignment tape, such as double-sided tape toward the snapping-clamp portion of the track assembly. Although not required, this is preferred as it holds the fabric 4 onto the upper plate 124 of the upper track 102, allowing a free end of the fabric to be inserted between the tracks 100 and 102 and clamped into place tightly.

The manner in which the first and second base track 100 and upper track 102 cooperate to facilitate the stretching and securing of the fabric 4, will now be evidenced by referring to FIGS. 5 and 6. The base track 100 is typically secured to the wall or other surface, such as with screws, nails, etc. The design of the base track 100 of the present invention provides access by various pneumatic and other tools for fastening purposes. Referring first to FIG. 5, the hinge portions 106 and 118 of the tracks 100 and 102 are operably joined together by inserting the second hinge portion of 118 into the channel 108 of the first hinge portion 106 such that a rotational or pivotal relationship is created between the tracks 100 and 102. The fabric 4 is then dropped over upper track 102 and the upper track moved toward the base track 100 until the hook and catch portions 112 and 122 or the clamping portions 110 and 120 engage with one another, securely locking the fabric 4 therebetween, as illustrated in FIG. 6. The result is a very tensioned and tight fabric extending between the assembly 10 as illustrated in FIGS. 1 and 6.

As discussed above, particularly in larger systems, the tension of the fabric 4 exerts a tremendous amount of force on the assembly 10, and particularly on the upper track 102, which force can cause the hinge assembly to flex rearward and fail, or the overall assembly 10 could be deformed and moved into a generally parallelogram shape. The present invention overcomes this problem with the addition of a strut 126, which extends downwardly towards the base track 100. As illustrated in FIGS. 3-6, the strut 126 is angled downwardly towards the hinge or dissipater of the assembly 10. The result is that if excessive tension forces are present, and the upper track 102 begins to be pulled rearwardly, the strut 126 will engage the base track 100 to transmit the tension forces into the base track 100, and thus into the surface of the wall 2. In a particularly preferred embodiment, the strut 126 is configured such so as to be moved into contact with the hinge portion 106 of the base track 100 such that the forces are transmitted to the hinge portion 106 and elevated segments 114 and 116 of the tension force dissipater so that they are transmitted through the segments 114 and 116 to the base plate 104 and wall 2. As illustrated in FIGS. 1-13 and 16, one end of the strut 126 extends downwardly from the upper plate of the upper track between the snapping clamp and hinge and extends at a non-perpendicular angle with respect to the upper track 102 towards an elevated surface of the base track facing the snapping clamp, such as the outer surface of the hinge portion 106 facing the snapping clamp 110 and 120, such that the strut 126 reinforces the track assembly and prevents the upper track 102 from moving rearwardly and opening the snapping clamp or distorting the track assembly. The strut 126, as illustrated in FIGS. 1-13 and 16 is compressed generally along a length thereof when moved into contact with the elevated surface of the base track facing the snapping clam in the presence of fabric tension forces on the assembly. Due to the transmission of these forces and the contact between the strut 126 and the base plate 100, the upper plate 102 remains in place and the fabric 4 remains tight. Moreover, the assembly 10 retains its generally square configuration and resists deforming.

Figure 7:
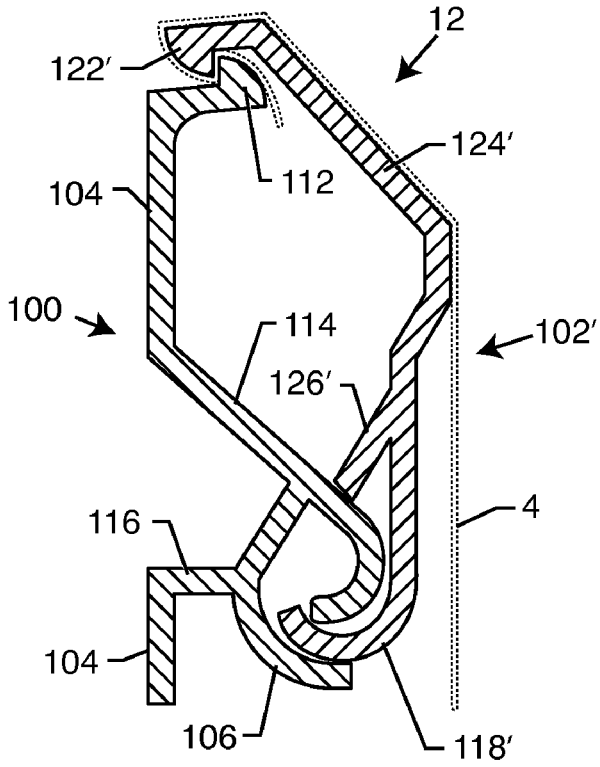
FIG. 7 is a cross-sectional view similar to FIG. 6, but illustrating a beveled configuration.
Figure 8:
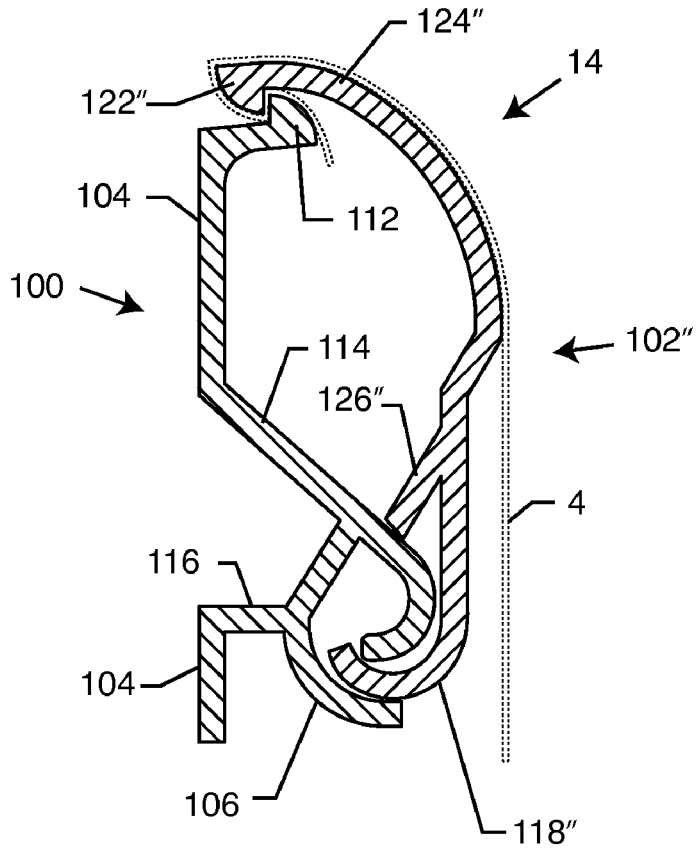
FIG. 8 is a cross-sectional view similar to FIG. 6, but illustrating a bull-nosed configuration.

With reference now to FIGS. 7 and 8, although the invention has been described above with respect to a square configuration or profile, it will be readily understood by those skilled in the art in the profile can be readily adapted. For example, in FIG. 7, assembly 12 is illustrated wherein the base track 100 is of the same configuration, but the upper plate 124' of the upper track 102' has an angled or beveled configuration and profile, which is sometimes desirable.

FIG. 8 is yet another assembly 14, embodying the present invention, wherein the base track 100 and its component parts are as described above, but the upper track 102" has an upper plate 124" having a sloping or configuration known in the art as a bull-nose profile. Otherwise, these assemblies 12 and 14 function in the same manner as described above.

Figure 9:
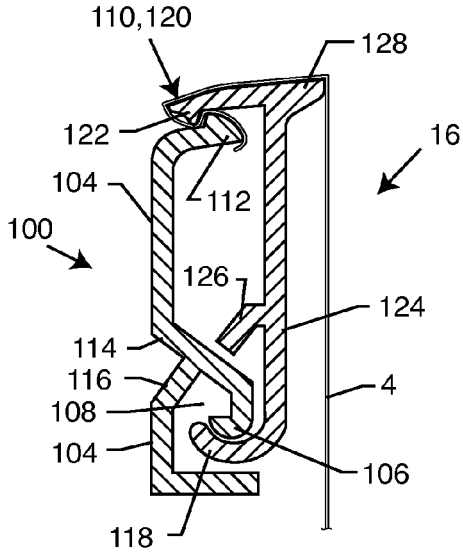
FIG. 9 is a cross-sectional view similar to FIG. 6, but illustrating a one-half inch system.
Figure 10:
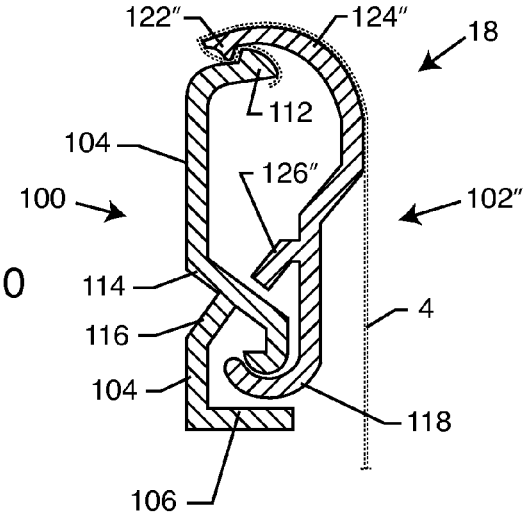
FIG. 10 is a cross-sectional view similar to FIG. 9, but illustrating a bull-nosed configuration.
Figure 11:
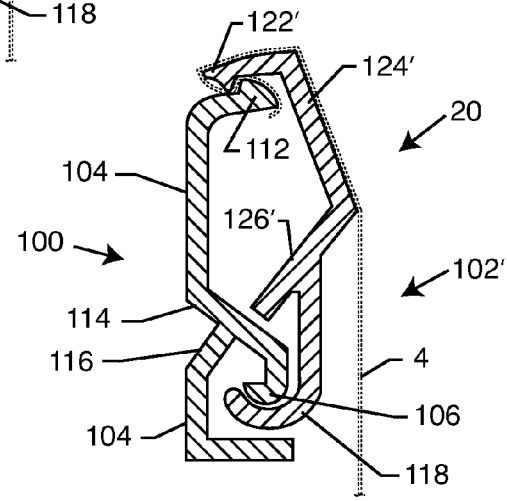
FIG. 11 is a cross-sectional view similar to FIG. 9, but illustrating a beveled configuration.

With reference now to FIGS. 9-11, although a one-inch thick system has been illustrated and described above, the present invention can be incorporated into other sizes as well, such as the illustrated one-half inch assemblies 16-20. However, the structure and function of the assemblies 16-20 are as described above, thus similar reference numbers have been used to identify similar structure in these embodiments 16-20.

Figure 12:
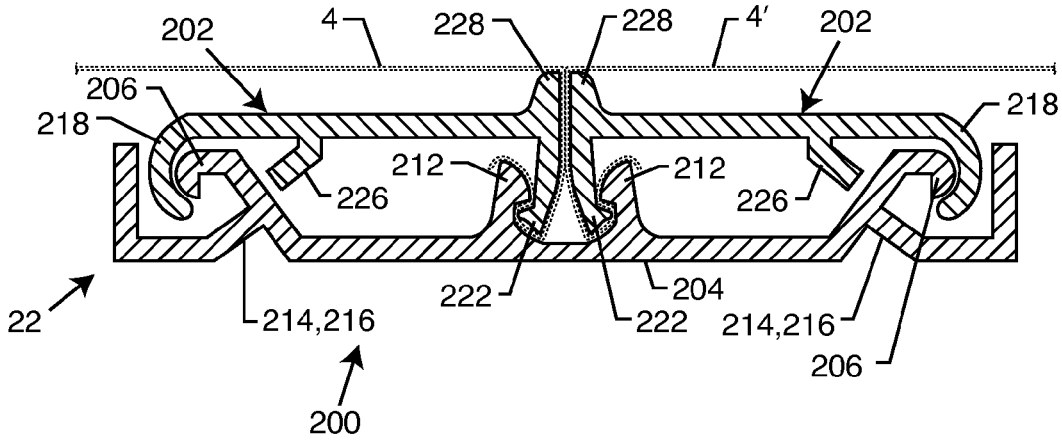
FIG. 12 is a cross-sectional view illustrating another track assembly embodying the present assembly for creating a seam between two pieces of fabric.

With reference now to FIG. 12, a seam can be formed between two pieces of fabric 4 and 4' by positioning two track assemblies in close proximity to one another and clamping the fabric 4 and 4' within the respective snapping clamps. Alternatively, as illustrated in FIG. 12, the two track assemblies may be constructed so as to share a common base track 200. The base track 200 would include opposite hinge portions 206 with tension force dissipaters 214 and 216 and a generally planar base plate 204 extending therebetween. Hooks or catches 212 would be spaced apart from one another and extend upwardly from the base plate 204 so as to form a snapping clamp with the diametrically opposed upper tracks 202. As illustrated, the two upper tracks 202 would each support a separate piece of fabric 4 and 4' and be swung towards one another and interlocked with the base track 200. Forces exerted on the assembly 22 would be handled in the same manner as that described above with the use of the strut 226 and dissipater 214, 216. Thus, tight seems can be formed between two pieces of fabric 4 and 4' without the need to carefully reposition the assemblies relative to one another.

Figure 13:
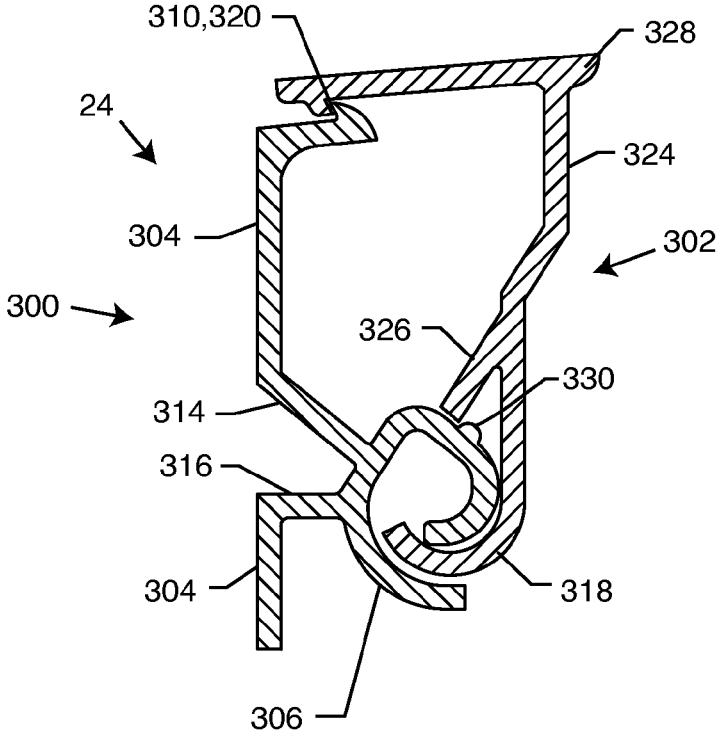
FIG. 13 is a cross-sectional view of another track assembly embodying the present invention.

With reference now to FIG. 13, yet another track assembly 24 embodying the present invention is illustrated. This embodiment 24 is very similar to the embodiment 10 illustrated and described above with respect to FIGS. 4-6. As such, the assembly 24 includes a base track 300 having a base plate 304, a first hinge portion 306, and a first snapping clamp portion 310. A tension force dissipater 314 and 316 elevated with respect to the base plate 304, and once again extending from the hinge portion 306 is also formed as part of the base track 300. The upper track 302 includes the second hinge portion 318, which operably mates with the first portion 306 to form the hinge, the upper plate 324 (which in this case is a square profile, but it will be readily appreciated that other profiles are possible), which extends down to the second half of the snapping clamp 320. The strut 326 extends downwardly towards the base track 300, and more particularly the second hinge portion 306 and tension force dissipater 314 and 316. However, in this case, a projection, such as a knob 330 is formed on the base track 300, and more particularly on the outer surface of the first hinge portion 306, such as the strut 326 is moved into contact with the first hinge portion 306, its rearward movement along the outer surface of the hinge is prohibited by the knob 330.

Figure 14:
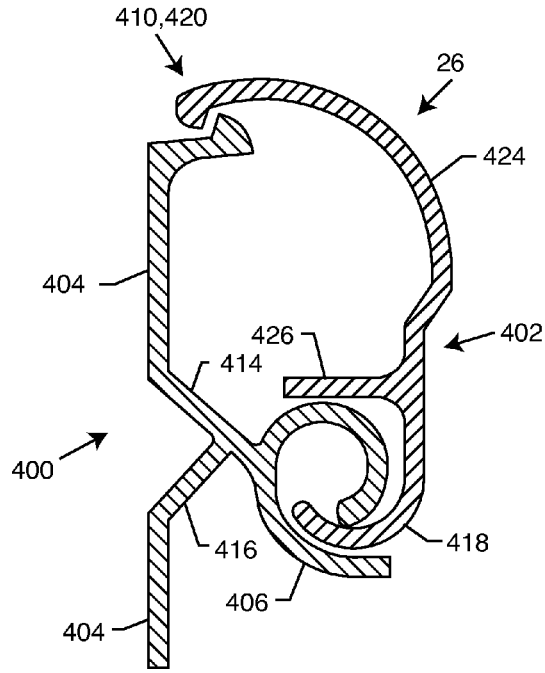
FIG. 14 is a cross-sectional view illustrating yet another embodiment of the track assembly of the present invention.

With reference now to FIG. 14, yet another track assembly 26 embodying the present invention is illustrated. Similar to that illustrated and described above, the base track 400 includes a base plate 404 having elevated sections 414 and 416 which define the tension force dissipater. The first hinge portion 406 is preferably elevated with respect to the base plate 404 and extends from the tension force dissipater 414 and 416. A first clamp portion 410 is formed generally opposite the hinge portion 406.

The upper track 402 includes the second hinged portion 418, which operable engages the first hinge portion 406 to form the hinge. Generally opposite this is formed the second snapping clamp half 420, which operably engages and interlocks with the first clamping half 410 of the base track 400. In this case, the upper plate 424 has a bull-nose profile, although others are contemplated. In this assembly 26, the strut 426 of the upper track 402 does not extend downwardly at an angle towards the hinge, but rather extends downwardly in front of the hinge 406 and 418. When excessive forces are applied to the upper track 402, the strut 426 is moved laterally into engagement with the lower hinge half 406, which transmits at least a portion of the tension forces through segments 414 and 416 to the base plate 404 and thus the surface or wall 2.

Figure 15:
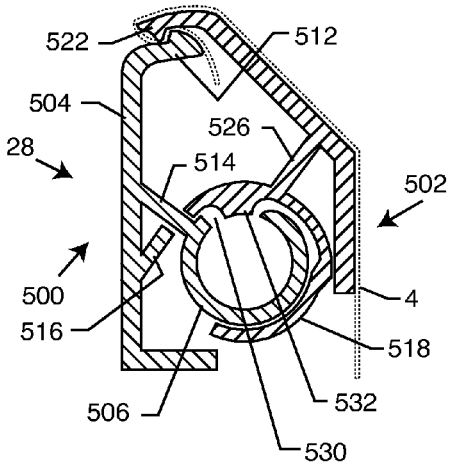
FIG. 15 is a cross-sectional view illustrating yet another embodiment of the track assembly.

With reference now to FIG. 15, yet another embodiment of the present invention is illustrated wherein the assembly 28 is similar to that described above, in the sense that it includes a base track 500 and an upper track 502 which are pivotally connected to one another and capable of being interlocked so as tension fabric 4. In this case, however, segments 514 and 516 forming the tension force dissipater extend upwardly from a continuous base plate 504. Segment 516 is separated slightly from the first hinge half 506. In this case, the first hinge half 506 is semi-circular so as to include a slot or key way 530. The second hinge portion 518 of the upper track 502 includes a tab or key 532 so as to be configured such so as to be received within the key way 530 when the assembly 28 is in a closed and locked position, as illustrated. The second portion of the hinge 518 is also semi-circular and extends around the first half of the hinge 506. The strut 526 extends from the upper plate 524 to the second hinge member 518. When excessive fabric tension forces are present, the strut 526 and second portion of hinge 518 engage the first portion of the hinge 506, causing it to transfer the forces into the base plate 504. In extreme cases, the hinge 506 is moved into contact with segment 516 to further transfer the forces into the base plate and wall surface 2.

With respect to the hinge 506 and 518, the larger hinge member is slightly heavier and exceeds 220° in circumference, enabling it to be removed and replaced over the inner hinge 506, which, because of the slot or key way 530, flexes as the outer second hinge half 518 is snapped into place and closed. When mated, the hinge assembly 506 and 518 can rotate from a full open (0° angle, to a fully closed and locked position at 90°, as illustrated). When in the full open position, the outer hinge portion 518 rotates on the inner hinge portion 506. As it rotates and is closed into a locked position, the tab or the tab 532 drops into the key way opening 530, allowing the entire outer portion 518 to shift laterally. This lateral shift assists the assembly 28 to securely lock the fabric 4 into place.

Figure 16:
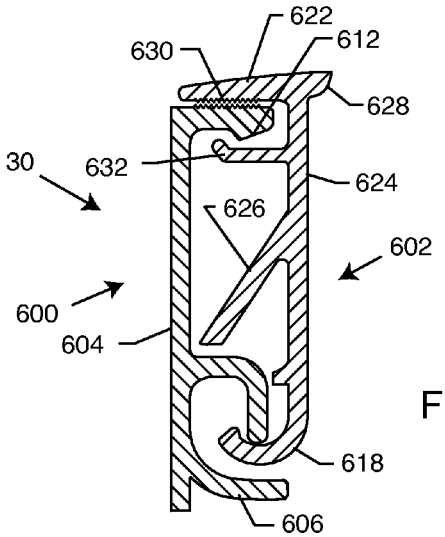
FIG. 16 is a cross-sectional view of yet another embodiment of the present invention.

With reference now to FIG. 16, similar to that as described above, the assembly 30 includes a base track 600 and an upper track 602, which operably lock and tension fabric. The base track 600 includes a generally planar base plate 604 having a first hinge half 606 formed on one end thereof and a first snapping tab portion 612 formed on an opposite end thereof.

The first hinge half 606 is formed in a generally C-shape, so as to removably receive a second hinge half portion 618 of the upper track assembly 602 therein to form pivotal engagement between the track 600 and 602. The upwardly extending catch 612 engages a downwardly directed hook 622 of the upper track 622. Serrations 630 frictionally engage the hook and catch 622 and 612 to one another. Fabric can be extended around an inner hook 632 to further hold the fabric therein.

In this case, the strut 626 extends downwardly towards the base track 600, and particularly the first half of the hinge 60. It will be noted, that the first half of the hinge 606 is not elevated with respect to the base plate 604, and thus does not have upwardly extending segments defining the tension force dissipater of the previous embodiments. Instead, when experiencing excessive tension forces by the tensioned fabric, the strut 626 moves into engagement with the base track 600, and in this case the hinge member 606 of the base track 600 so as to prevent the upper track 602 from excessive movement and deformation while transmitting a portion of the tension forces into the base track 600, and thus the wall surface 2. Once again, a tab 628 can be used to prevent shadow effects, similar to that described above.

The track assemblies of the present invention are produced in common architectural designs prevalent in wall upholstery track systems. The assemblies enable the taut installation of fabric or vinyl on the wall or acoustical panels, which can be removed in the future for decoration or equipment access changes and the like without the need to replace the entire panel. Thus, the present invention provides a significant cost savings to end users. The forces applied by fabric are directed into the assembled hinge and cannot escape. The assemblies are designed so as to minimize any shadow effects, and prevent the outer member from popping out when under increasing tension as it is rotated and closed. The assemblies of the present invention also enable the installers to more easily open and close the assemblies without resorting to excessive pounding with mallets and the like.

Although several embodiments have been described in detail for purposes of illustration, various modifications may be made to each without departing from the scope and spirit of the invention. Accordingly, the invention is not to be limited, except as by the appended claims.

What is claimed is:

1. A track assembly supporting a fabric on a wall or ceiling surface under tension, comprising:

a base track including a first half of a hinge defined by a curved member having an outer surface and an inner surface defining a cavity, a first half of a snapping clamp spaced apart from the first half of the hinge and a base plate extending between the first half of the hinge and the first half of the snapping clamp for contact with the surface;

an upper track including a second half of the hinge defined by a curved member at least partially insertable into the cavity and rotatable within the cavity of the first half of the hinge member so as to cooperatively form a hinge, and a second half of the snapping clamp releasably lockable with the first half of the snapping clamp to cooperatively form a snapping clamp for releasably locking the fabric therebetween, and an upper plate extending between the second half of the hinge and the second half of the snapping clamp;

an elongated strut disposed intermediate the second half of the hinge and the second half of the snapping clamp and extending at one end thereof from the upper plate at a non-perpendicular angle with respect to the upper plate away from the snapping clamp and towards the outer surface of the first half of the hinge facing the snapping clamp;

wherein after securement of the base track to the surface, the upper track is hinged to the base track with the coupling of the first and second halves of the hinge, the upper track then swingable about the hinge away from the surface to facilitate placement of the fabric over the second half of the snapping clamp and subsequent swinging of the upper track towards the base track causing the first and second halves of the snapping clamp to secure and releasably lock the fabric therebetween; and wherein in the presence of forces applied to the track assembly by the fabric, the strut extends between the upper track and the outer surface of the first hinge member of the base track to resist opening of the snapping clamp and distortion of the track assembly due to the fabric tension forces.

2. The assembly of claim 1, wherein the strut is compressed generally along a length thereof in response to engagement with the upper track and the first half of the hinge and the presence of fabric tension forces.

3. The assembly of claim 1, wherein the second half of the snapping clamp of the upper track comprises a hook, and the first half of the snapping clamp of the base track comprises a catch, which are configured to releasably engage and form the snapping clamp.

4. The assembly of claim 1, wherein the first half hinge includes segments extending from the curved member to the base track to elevate the curved member with respect to the base plate, the segments and the curved member comprising a tension force dissipater at least a portion of which facing the snapping clamp engages the strut when fabric tension forces are applied to the track assembly.

5. The assembly of claim 4, wherein the segments form a generally inverted V-shape with respect to the base plate.

6. The assembly of claim 1, including a longitudinal tab extending upwardly from the upper plate of the upper track adjacent to the second half of the snapping clamp to raise the fabric above the upper plate and prevent shadowing effects.

7. The assembly of claim 1, including a projection extending from the outer surface of the first half of the hinge facing the snapping clamp to limit the movement of a second end of the strut along the surface of the first half of the hinge due to high tension forces.

8. A track assembly supporting a fabric on a wall or ceiling surface under tension, comprising:

a base track including a first half of a hinge defined by a curved member having an outer surface and an inner surface defining a cavity, a first half of a snapping clamp spaced apart from the first half of the hinge and a base plate extending between the first half of the hinge and the first half of the snapping clamp for contact with the surface;

an upper track including a second half of the hinge defined by a curved member at least partially insertable into the cavity and rotatable within the cavity of the first half of the hinge member so as to cooperatively form a hinge, and a second half of the snapping clamp releasably lockable with the first half of the snapping clamp to cooperatively form a snapping clamp for releasably locking the fabric therebetween, and an upper plate extending between the second half of the hinge and the second half of the snapping clamp;

an elongated strut disposed intermediate the second half of the hinge and the second half of the snapping clamp and extending from the upper plate towards the base track;

wherein after securement of the base track to the surface, the upper track is hinged to the base track with the coupling of the first and second halves of the hinge, the upper track then swingable about the hinge away from the surface to facilitate placement of the fabric over the second half of the snapping clamp and subsequent swinging of the upper track towards the base track causing the first and second halves of the snapping clamp to secure and releasably lock the fabric therebetween; and wherein in the presence of forces applied to the track assembly by the fabric, at least a portion of the strut engages the outer surface of the first hinge member of the base track to resist opening of the snapping clamp and distortion of the track assembly due to the fabric tension forces.

9. The assembly of claim 8, wherein the second half of the snapping clamp of the upper track comprises a hook, and the first half of the snapping clamp of the base track comprises a catch, which are configured to releasably engage and form the snapping clamp.

10. The assembly of claim 8, wherein the first half hinge includes segments extending from the curved member to the base track to elevate the curved member with respect to the base plate, the segments and the curved member comprising a tension force dissipater at least a portion of which facing the snapping clamp engages the strut when fabric tension forces are applied to the track assembly.

11. The assembly of claim 10, wherein the segments form a generally inverted V-shape with respect to the base plate.

12. The assembly of claim 8, including a longitudinal tab extending upwardly from the upper plate of the upper track adjacent to the second half of the snapping clamp to raise the fabric above the upper plate and prevent shadowing effects.

13. A track assembly supporting a fabric on a wall or ceiling surface under tension, comprising:

a base track including a first half of a hinge defined by a curved member having an outer surface and an inner surface defining a cavity, a first half of a snapping clamp spaced apart from the first half of the hinge and a base plate extending between the first half of the hinge and the first half of the snapping clamp for contact with the surface;

an upper track including a second half of the hinge defined by a curved member at least partially insertable into the cavity and rotatable within the cavity of the first half of the hinge member so as to cooperatively form a hinge, and a second half of the snapping clamp releasably lockable with the first half of the snapping clamp to cooperatively form a snapping clamp for releasably locking the fabric therebetween, and an upper plate extending between the second half of the hinge and the second half of the snapping clamp;

an elongated strut disposed intermediate the second half of the hinge and the second half of the snapping clamp and extending at one end thereof from the upper plate at a non-perpendicular angle with respect to the upper plate away from the snapping clamp and towards an elevated surface of the base track facing the snapping clamp;

wherein after securement of the base track to the surface, the upper track is hinged to the base track with the coupling of the first and second halves of the hinge, the upper track then swingable about the hinge away from the surface to facilitate placement of the fabric over the second half of the snapping clamp and subsequent swinging of the upper track towards the base track causing the first and second halves of the snapping clamp to secure and releasably lock the fabric therebetween; and wherein in the presence of forces applied to the track assembly by the fabric, the strut extends between the upper track and the elevated surface of the base track to resist opening of the snapping clamp and distortion of the track assembly due to the fabric tension forces.

14. The assembly of claim 13, wherein the strut is compressed generally along a length thereof in response to engagement with the upper track and the base track in the presence of fabric tension forces.

15. The assembly of claim 13, wherein the second half of the snapping clamp of the upper track comprises a hook, and the first half of the snapping clamp of the base track comprises a catch, which are configured to releasably engage and form the snapping clamp.

16. The assembly of claim 13, wherein the elevated portion of the base track comprises the first half of the hinge.

17. The assembly of claim 13, wherein the first half hinge includes segments extending from the curved member to the base track to elevate the curved member with respect to the base plate, the segments and the curved member comprising a tension force dissipater at least a portion of which facing the snapping clamp engages the strut when fabric tension forces are applied to the track assembly.

18. The assembly of claim 17, wherein the segments form a generally inverted V-shape with respect to the base plate.

19. The assembly of claim 13, including a longitudinal tab extending upwardly from the upper plate of the upper track adjacent to the second half of the snapping clamp to raise the fabric above the upper plate and prevent shadowing effects.

20. The assembly of claim 16, including a projection extending from the outer surface of the first half of the hinge facing the snapping clamp to limit the movement of a second end of the strut along the surface of the first half of the hinge due to high tension forces.

21. A track assembly for supporting fabric on a wall or ceiling surface under tension, comprising:

a base track including a first half of a hinge defined by a curved member, a first half of a snapping clamp spaced apart from the first half of the hinge and a base plate extending between the first half of the hinge and the first half of the snapping clamp;

an upper track including a second half of the hinge defined by a curved member rotatably coupled to the first half of the hinge member so as to cooperatively form a hinge, and a second half of the snapping clamp releasably lockable with the first half of the snapping clamp to cooperatively form a snapping clamp for releasably locking fabric therebetween, and an upper plate extending between the second half of the hinge and the second half of the snapping clamp; and an elongated strut disposed intermediate the second half of the hinge and the second half of the snapping clamp and extending from the upper plate at a non-perpendicular angle with respect to the upper plate away from the snapping clamp and towards an elevated surface of the base track facing the snapping clamp;

wherein in the presence of tension fabric forces acting on the track assembly, the elongated strut extends between the upper plate and the elevated surface of the base track and is compressed therebetween, to reinforce the track assembly and resist opening of the snapping clamp and distortion of the track assembly due to the fabric tension forces.

22. The assembly of claim 21, wherein the elevated surface of the base track comprises an outer surface of the hinge facing the snapping clamp.

23. The assembly of claim 21, wherein the second half of the snapping clamp of the upper track comprises a hook, and the first half of the snapping clamp of the base track comprises a catch, which are configured to releasably engage and form the snapping clamp.

24. The assembly of claim 21, wherein the first half hinge includes segments extending from the curved member to the base track to elevate the curved member with respect to the base plate, the segments and the curved member comprising a tension force dissipater at least a portion of which facing the snapping clamp engages the strut when fabric tension forces are applied to the track assembly.

25. The assembly of claim 24, wherein the segments form a generally inverted V-shape with respect to the base plate.

26. The assembly of claim 21, including a longitudinal tab extending upwardly from the upper plate of the upper track adjacent to the second half of the snapping clamp to raise fabric above the upper plate and prevent shadowing effects.

27. The assembly of claim 21, including a projection extending from the elevated surface of the base track facing the snapping clamp to limit the movement of a free end of the strut along the surface and away from the base plate due to high tension fabric forces.

* * * * *